US007018032B2

(12) United States Patent
Merz et al.

(10) Patent No.: US 7,018,032 B2
(45) Date of Patent: Mar. 28, 2006

(54) INTERNAL VENTING STRUCTURE FOR FLUID TANKS

(75) Inventors: Eric A. Merz, Palmyra, NY (US); Brian S. Hilton, Penfield, NY (US)

(73) Assignee: Fuji Xerox Co., Ltd., Tokyo (JP)

( * ) Notice: Subject to any disclaimer, the term of this patent is extended or adjusted under 35 U.S.C. 154(b) by 227 days.

(21) Appl. No.: 10/752,718

(22) Filed: Jan. 8, 2004

(65) Prior Publication Data

US 2005/0151798 A1 Jul. 14, 2005

(51) Int. Cl.
*B41J 2/87* (2006.01)

(52) U.S. Cl. ..... 347/87

(58) Field of Classification Search ..... 347/84, 347/85, 86, 87, 92
See application file for complete search history.

(56) References Cited

U.S. PATENT DOCUMENTS 4,571,599 A * 2/1986 Rezanka ..... 347/87
4,639,748 A 1/1987 Drake et al.
5,124,717 A 6/1992 Campanelli et al.
5,138,332 A * 8/1992 Carlotta ..... 347/92
5,141,596 A 8/1992 Hawkins et al.
5,204,690 A 4/1993 Lorenze, Jr. et al.
5,905,518 A * 5/1999 DeFilippis ..... 347/85
6,022,102 A * 2/2000 Ikkatai et al. ..... 347/85
6,409,302 B1 * 6/2002 Altfather et al. ..... 347/19
6,447,109 B1 * 9/2002 Williamson et al. ..... 347/85
6,520,630 B1 * 2/2003 Oda et al. ..... 347/85

OTHER PUBLICATIONS

U.S. Appl. No. 10/455,357 to Eric A. Merz et al., filed Jun. 6, 2003.
U.S. Appl. No. 10/747,396 to Brian S. Hilton et al., filed Dec. 30, 2003.

* cited by examiner

*Primary Examiner*—Anh T. N. Vo
(74) *Attorney, Agent, or Firm*—Oliff & Berridge PLC

(57) ABSTRACT

A refillable fluid container system having a communication channel between the manifold and fluid reservoir that allows air to vent from the manifold to an air accumulation area with in the fluid resevoir.

21 Claims, 5 Drawing Sheets

INTERNAL VENTING STRUCTURE FOR FLUID TANKS

BACKGROUND OF THE INVENTION

1. Field of Invention

This invention relates to an internal fluid tank venting structure in a refillable fluid container.

2. Description of Related Art

Fluid ejector systems, such as drop-on-demand liquid ink printers, have at least one fluid ejector from which droplets of fluid are ejected towards a receiving sheet. Scanning inkjet printers are equipped with fluid ejection heads containing fluid ink. The ink is applied to a sheet in an arrangement based on print data received from a computer, scanner or similar device. To control the delivery of the fluid to the sheet, fluid ejection heads are moved across the sheet to provide the fluid to the sheet, which is ejected as drops. These drops correspond to a liquid volume designated as pixels. Each pixel is related to a quantity needed to darken or cover a particular unit area.

Integral fluid filters are known. Examples of such integral fluid filters, used for ink jet printheads, are U.S. Pat. No. 4,639,748 to Drake et al., U.S. Pat. No. 5,124,717 to Campanelli et al., U.S. Pat. No. 5,141,596 to Hawkins et al., and U.S. Pat. No. 5,204,690 to Lorenze, Jr. et al.

Of these, only U.S. Pat. No. 4,639,748 includes an integral, internal ink filter positioned within the channel plate before the individual ink channel nozzles. The other cited references include a membrane filter fabricated over an ink fill opening between an ink supply cartridge and the ink manifold of the printhead (i.e., external to the channel plate and affixed to an outer face thereof). As such, these latter patents require additional fabrication costs and time to pattern and implement the ink filter assembly. Further, such a filter is quite removed from the nozzles.

SUMMARY OF THE INVENTION

In ink jet printers, very small nozzles having correspondingly small flow areas are required to produce small ink droplets for printing. Current ink jet trends are requiring smaller and smaller ink droplets. This necessitates the use of a very fine filtration system to prevent contaminating particles from clogging the small printhead nozzles. Once wetted with ink, however, the filtration system becomes an effective barrier to air transmission.

During printing, the printhead can ingest or create air, and this air may be trapped in the manifold area, between the printing die and the filter. Because the jets also do not easily allow air to escape the manifold, air will become trapped inside the manifold. When the volume of air trapped in the manifold area is sufficiently large, the air can disrupt or prevent the flow of fluid. The printhead may be harmed by this disruption, and may lose the ability to print.

In some conventional systems including replacable, refillable or umbilical fluid supplies, some air can be purged by vacuum. This is not, however, a reliable or effective method for printheads having torturous and small fluid channels necessary for high resolution printing.

In the conventional printhead art, these problems are addressed by designing the printhead to accommodate a large volume of air before the end of the life of the printhead. This architecture has significant drawbacks, including wasted space in the printhead, increased size and weight of the printhead, and the attendant cost increases and productivity decreases.

Similarly, other containers for consumable fluids in various applications of fluid ejection may require sensing fluid level for refill or replacement of the fluid in a fluid reservoir. Such applications include, but are not limited to dispensing medication, pharmaceuticals, photo results and the like onto a receiving medium, injecting reducing agents into engine exhaust to control emissions, draining condensation during refrigeration, etc. Other technologies that use refillable fluid containers include fuel cells, fuel tanks, chemical handling systems and electric batteries. Fluid level sensing in fluid container in these technologies is difficult because electrical fluid sensing may introduce hazards, e.g., spark ignition into the fluid contained in the fluid container, or in which the fluid may deteriorate the electrical sensors, e.g., from corrosion.

The present invention overcomes the above problems by providing a bypass channel allowing air to vent from the manifold area to the area above the fluid level in the printhead. In particular, the invention in exemplary embodiments provides a filter portion formed in the printhead and a communication channel between the manifold and fluid reservoir areas of the printhead.

This invention provides devices and methods for allowing air to escape from the manifold to the fluid reservoir.

This invention separably provides devices and methods for providing a one-way channel for passage of air and fluid from the manifold to the fluid reservoir.

These and other features and advantages of this invention are described in, or are apparent from, the following detailed description of various exemplary embodiments of the systems and methods according to this invention.

DETAILED DESCRIPTION OF PREFERRED EMBODIMENTS

The following detailed description of various exemplary embodiments of the fluid containers having a communication channel between the manifold and ink reservoir, according to this invention may refer to one specific type of fluid system, e.g., an inkjet printer that uses the refillable fluid containers according to this invention, for sake of clarity and familiarity. However, it should be appreciated that the principles of this invention, as outlined and/or discussed below such as those described above, can be equally applied to any known or later-developed fluid ejection systems, beyond the ink jet printer specifically discussed herein.

Figure 1:
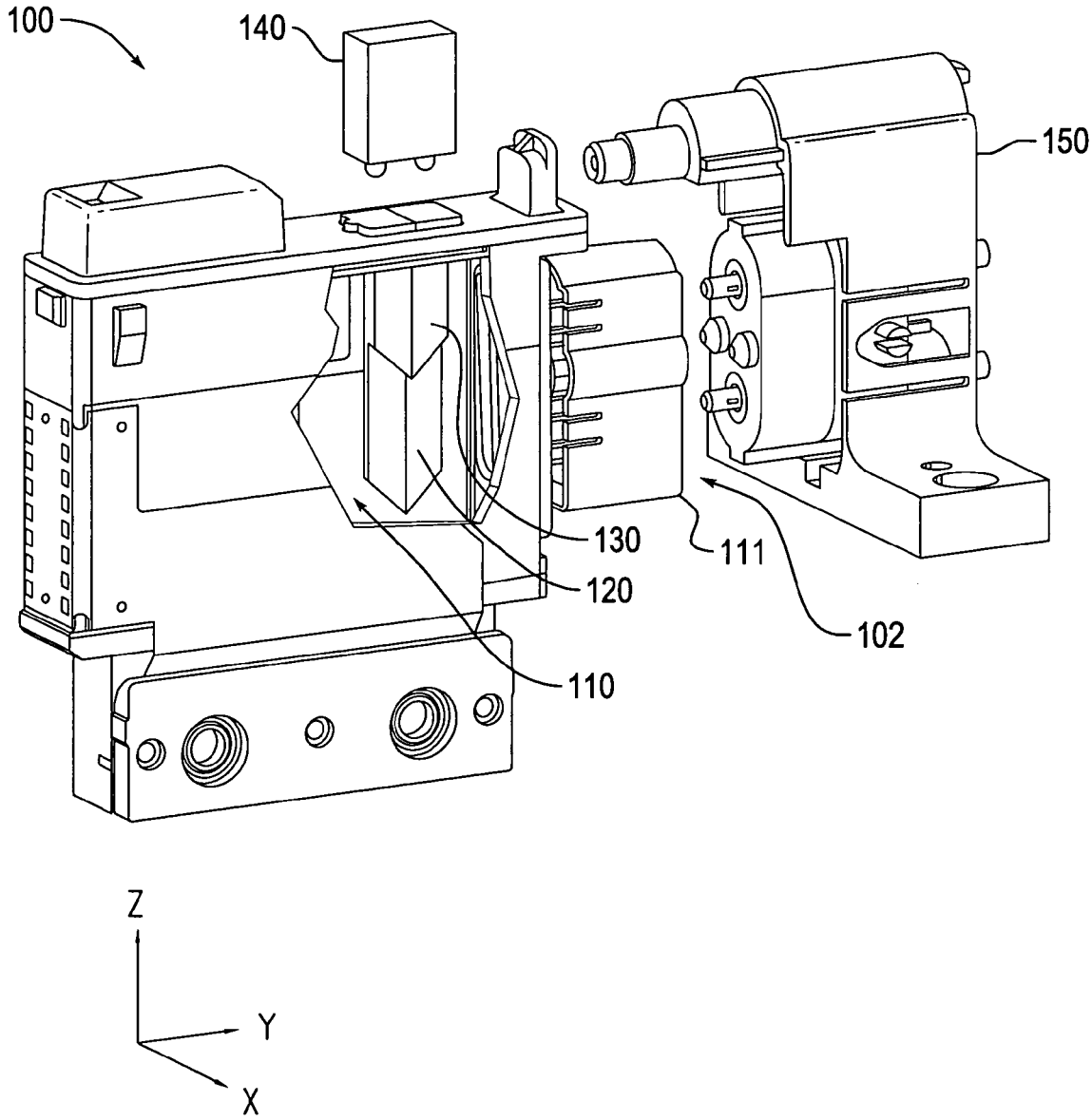
FIG. 1 is an isometric view of a conventional refillable fluid container.

FIG. 1 shows a conventional refillable fluid container, including a fluid ejection head 100 usable with a fluid refill system. As shown in FIG. 1, the fluid ejection head 100 includes the refillable fluid container or reservoir 110 with sensor systems 120 and 130 and a detector 140. The fluid reservoir 110 of the fluid ejection head 100 can be connected to a refill station 140 when the detector 150 detects, for example, that the fluid level in the fluid reservoir 110 has fallen below the lower prism or sensor target 120. Subsequently, the fluid reservoir 110 of the fluid ejection head 100 can be disconnected from the refill station 150 when the detector 140 detects that the level in the fluid reservoir 110 has risen to, for example, a position above the upper prism or sensor target 130.

The fluid ejector may include a calibration measurement instrument. Any suitable calibration measuring instrument may be used, including but not limited to optical level sensing systems. One optical level sensing system is described, for example, in U.S. patent application Ser. No. 10/455,357 filed Jun. 6, 2003, which is incorporated by reference herein in its entirety. As manufactured, the fluid ejector contains a full quantity of fluid. The fluid is expended by the fluid ejector ejecting a quantity of the fluid that corresponds to a pixel on a sheet that receives the fluid. These ejecting commands can be counted by incrementing an initial count for each ejected quantity of fluid or for a number of such ejection events. Once the fluid remaining in the fluid reservoir has been reduced so that the indicated fluid level falls below the lower threshold prism or sensor target, the fluid quantity (by volume) between upper and lower threshold levels can be divided by the number of the fluid printing ejections counted to determine the volume of the fluid ejected per pixel or fluid ejecting command for that fluid ejector.

Figure 2:
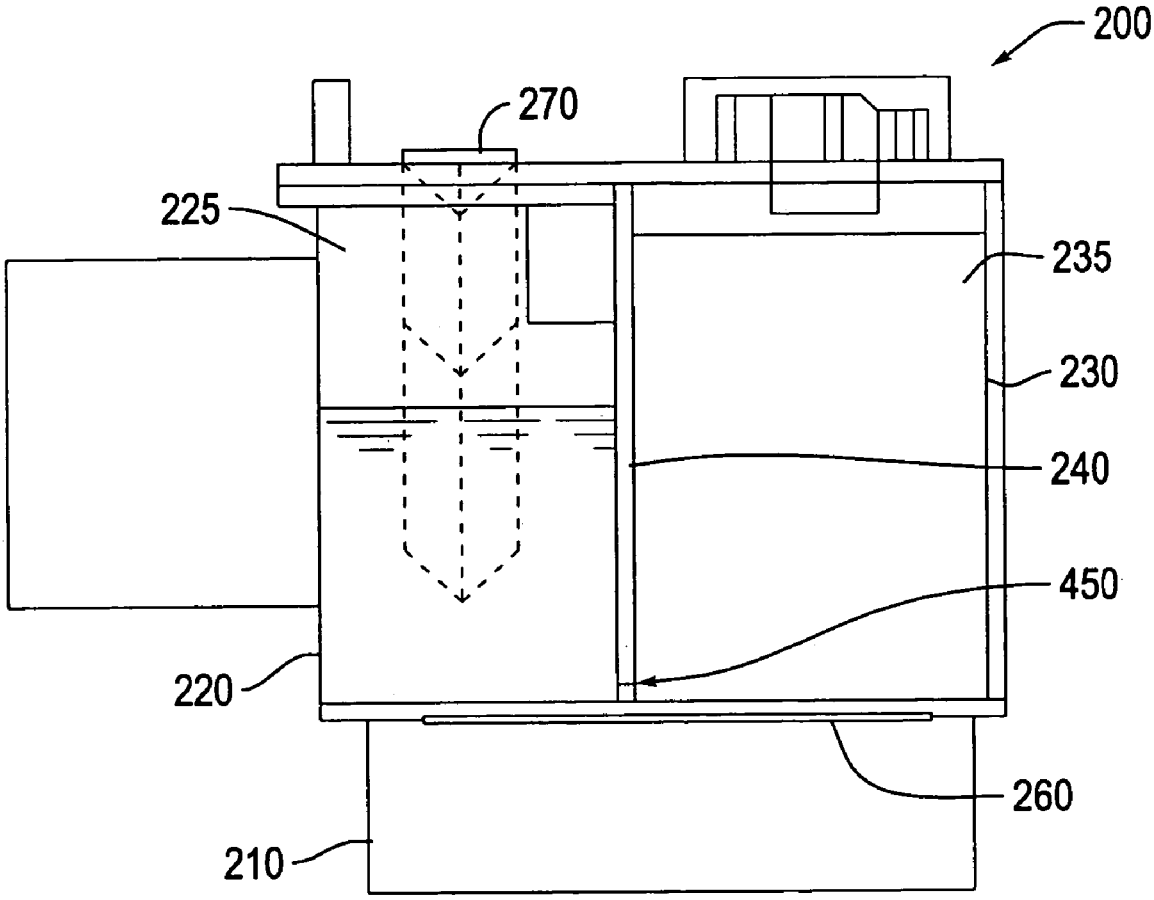
FIG. 2 is an enlarged cross-sectional schematic view of a conventional refillable fluid container such as FIG. 1, as viewed along a y-z plane.

FIG. 2 shows a cross-sectional view of a conventional refillable fluid container 200, as viewed along a y-z plane. The refillable fluid container 200 includes a manifold area 210, a liquid fluid reservoir 220 and an optional capillary fluid reservoir 230. The optional capillary fluid reservoir 230 includes a capillary insert medium 235 for fluid storage. The liquid fluid reservoir 220 includes an air accumulation area 225, above the level of the fluid to be contained therein. The liquid fluid reservoir 220 and optional capillary fluid reservoir 230 are separated by a barrier wall 240. Communication between the liquid fluid reservoir 220 and optional capillary fluid reservoir 230 is enabled by orifice 250 in barrier wall 240. The liquid fluid reservoir 220 and manifold area 210 are separated by a filter means 260. The liquid fluid reservoir 220 may optionally contain an optical level sensing system 270.

Figure 3:
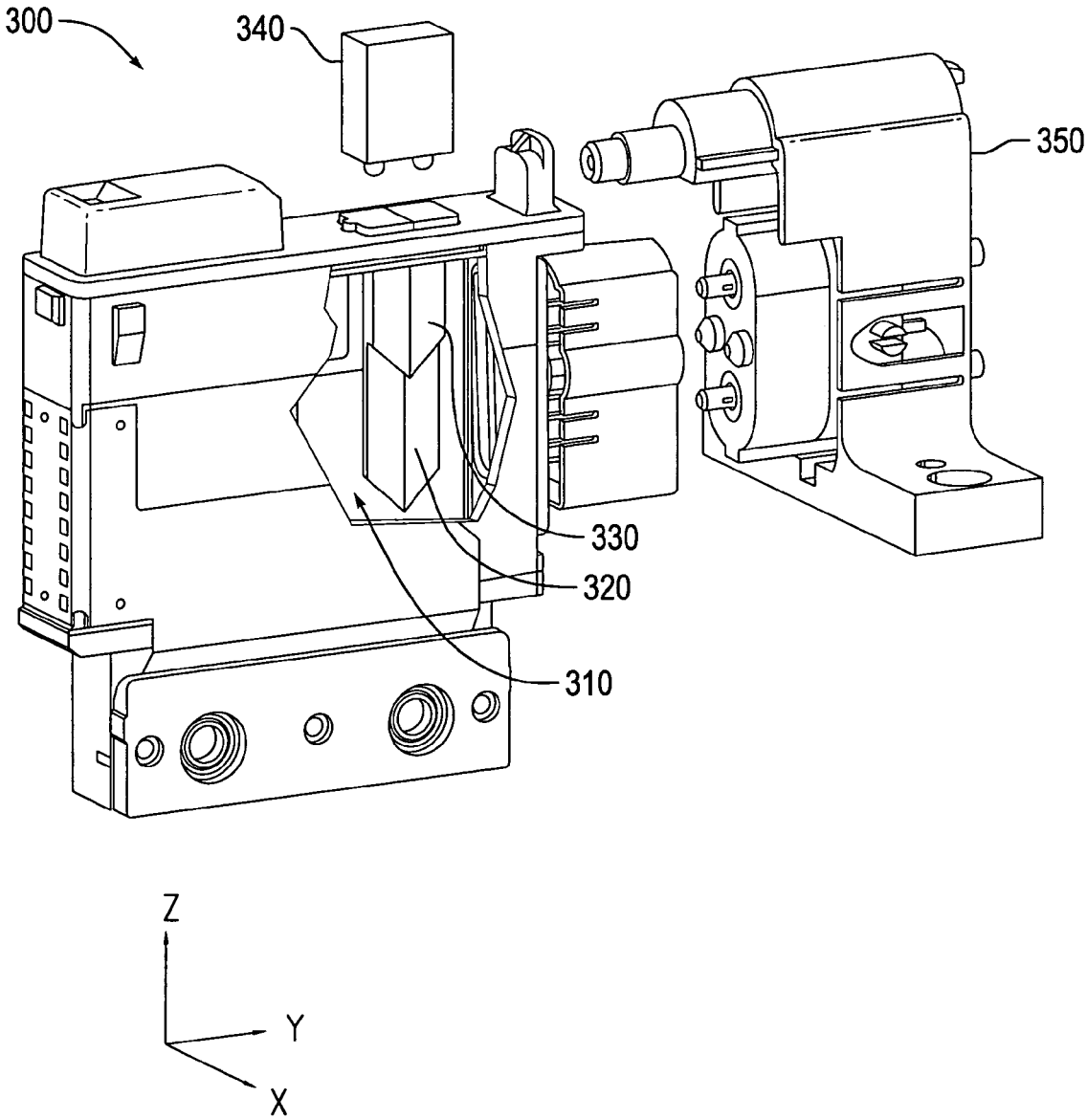
FIG. 3 is an isometric view of an exemplary embodiment of a refillable fluid container according to this invention.

FIG. 3 shows a fluid ejection head 300 usable with a fluid refill system according to this invention. As shown in FIG. 3, the fluid ejection head 300 includes the refillable fluid container or reservoir 310 with optical prisms or sensor targets 320 and 330 and a detector 340. The fluid reservoir 310 of the fluid ejection head 300 can be connected to a refill station 350 when the detector 350 detects, for example, that the fluid level in the fluid reservoir 310 has fallen below the lower prism or sensor target 320. Subsequently, the fluid reservoir 310 of the fluid ejection head 300 can be disconnected from the refill station 350 when the detector 340 detects that the level in the fluid reservoir 310 has risen to, for example, a position above the upper prism or sensor target 330.

Figure 4:
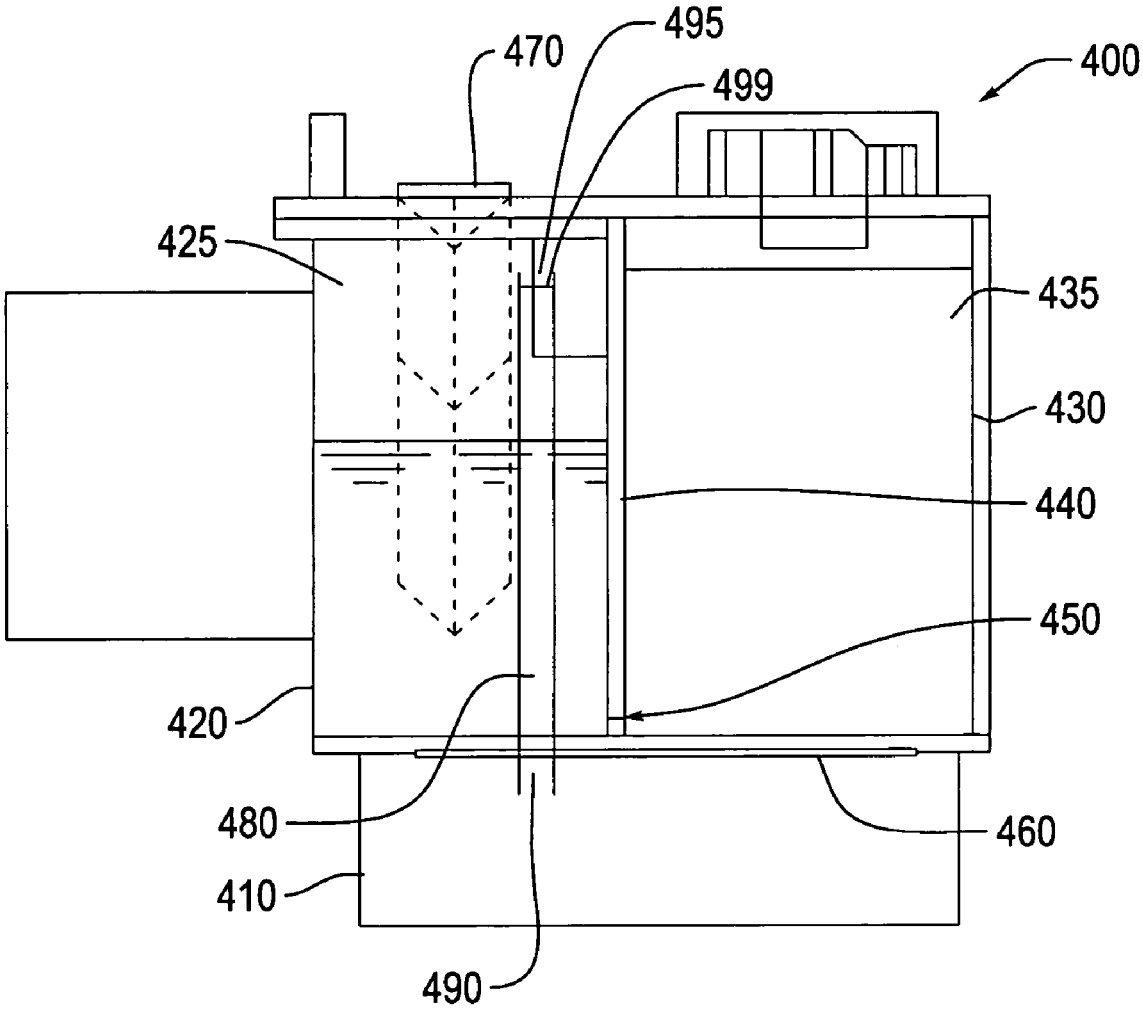
FIGS. 4 and 5 are enlarged cross-sectional schematic views of exemplary embodiments of a refillable fluid container such as FIG. 3, as viewed along a y-z plane.
Figure 5:
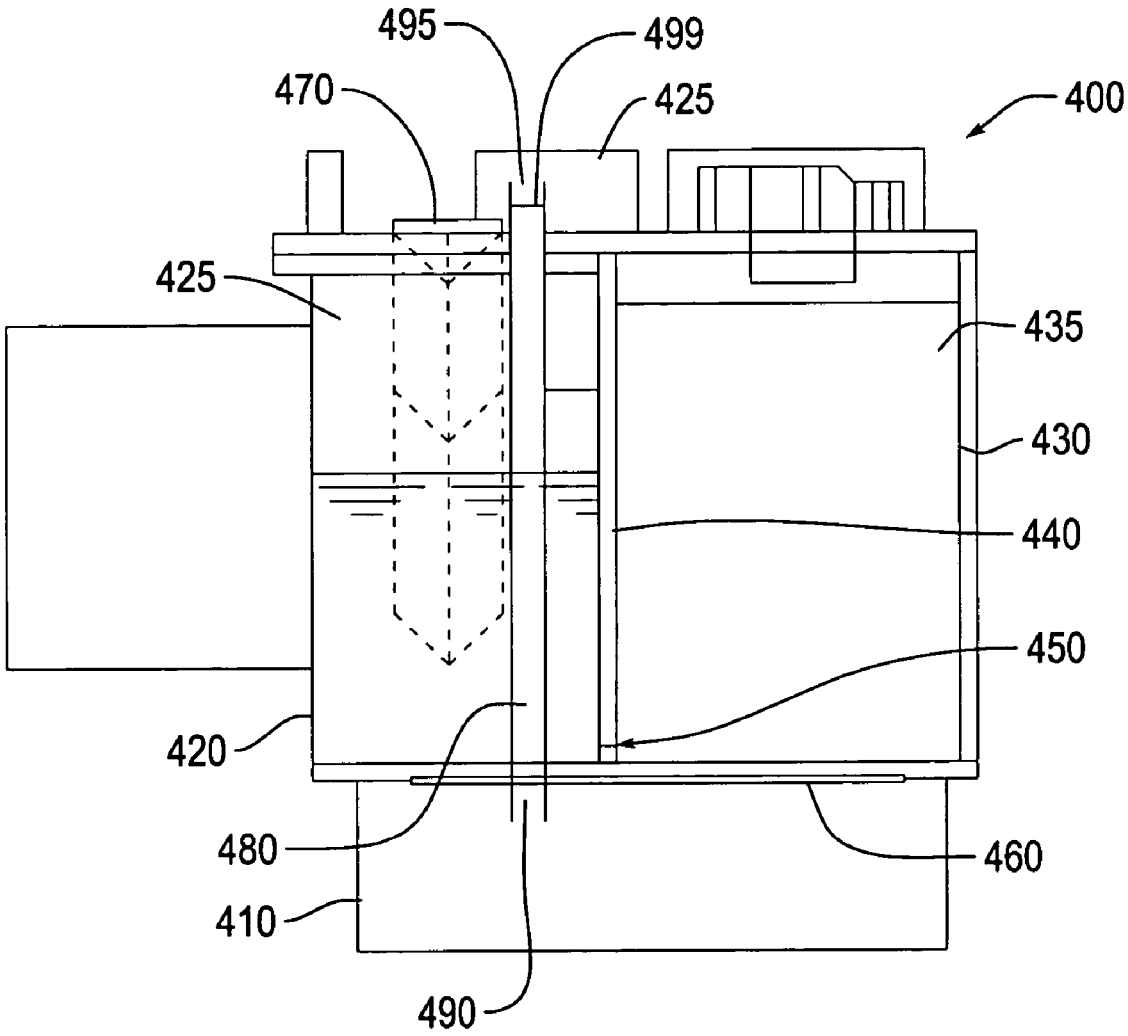

FIG. 4 shows a cross-sectional view of a refillable fluid container 400 according to this invention, as viewed along a y-z plane. Similarly, FIG. 5 shows a cross-sectional view of a refillable fluid container 500 according to this invention, as viewed along a y-z plane The refillable fluid containers 400 and 500 include a manifold area 410, a liquid fluid reservoir 420 and an optional capillary fluid reservoir 430. The optional capillary fluid reservoir 430 includes an optional capillary medium 435 for fluid storage. The liquid fluid reservoir 420 and optional capillary fluid reservoir 430 are separated by a barrier wall 440. Communication between the liquid fluid reservoir 420 and optional capillary fluid reservoir 430 is enabled by orifice 450 in barrier wall 440. The liquid fluid reservoir 420 includes an air accumulation area 425. The liquid fluid reservoir 420 and manifold area 410 are separated by a barrier means 460. The liquid fluid reservoir 420 may optionally include an optical level sensing system 470.

The manifold area 410 is connected to the liquid fluid reservoir 420 by a channel 480. The barrier means 460 can be any suitable barrier, such as a microporous filter, which is permeable to the fluid but prevents the passage of impurities from the liquid fluid reservoir 420 into the manifold area 410.

Air in the manifold area 410 is allowed to flow through the channel 480 and collect in the air accumulation area 425 of the liquid fluid reservoir 420. The air accumulation area 425 can be located either inside the liquid fluid reservoir 420, as shown in FIG. 4, outside the main body of the liquid fluid reservoir 420, as in FIG. 5, or in any like location. For example, air accumulation area 425 in FIG. 5 may be in fluid communication with fluid reservoir 420 but located above it. This allows increased fluid capacity in fluid reservoir 420 while decreasing the chance of fluid entering the channel 480 by a flow-limiting geometry in which the cross-sectional area at least in the vicinity of the channel 480 (i.e., at the interface between the air accumulation area 425 and fluid reservoir 420) is reduced so as to restrict the flow of fluid that may reach the top of channel 480. This reduces a chance of fluid spillage if the container is overfilled or tipped on its side. One way to form air accumulation area 425 is to form a top cover of the fluid reservoir 420 with an upwardly extending portion as shown having a reduced cross-section relative to the cross-section of the fluid reservoir 420.

Additionally, in exemplary embodiments, the flow limiting mechanism 499 may be provided externally from channel 480, such as by providing a filter material that covers the cross-sectional area between the channel 480 and side walls of the air accumulation area 425.

Air inside the air accumulation area 425 of the liquid fluid reservoir 420 can be managed by the pressure control system used in the liquid fluid reservoir 420. Such pressure control systems are known in the art and include but are not limited to purging the air when fluid is refilled by a vacuum filling system, discarding the air when the fluid supply is discarded and purging the air via a check valve when fluid is supplied through an umbilical cord.

In various exemplary embodiments, the channel 480 includes an aperture 490 allowing free communication between the manifold area 410 and the channel 480, and an aperture 495 allowing communication between the liquid fluid reservoir area 420 and the channel 480.

In various exemplary embodiments, aperture 490 is positioned in the air accumulation area 425 above the fluid level in the manifold area 410 to allow air trapped in the manifold area 410 to escape to the air accumulation area 425 of the liquid fluid reservoir 420. In various exemplary embodiments, the aperture 490 is located near the filter means 460.

The location of aperture 495 is not particularly limited. In various exemplary embodiments, aperture 495 is preferably positioned in the air accumulation 425 of the liquid fluid reservoir 420.

In various exemplary embodiments, channel 480 includes a flow limiting mechanism 499. Flow limiting device 499 allows trapped air to flow from the manifold area 410, but does not allow fluid from the liquid fluid reservoir 420 to flow to the manifold area 410. Any suitable flow limiting means may be used as flow limiting mechanism 499, provided the flow limiting means allows the flow of gases and fluids in only one direction. For exemplary purposes only, such flow limiting mechanisms may include filter materials, such as, for example, POREX and fabric materials such as, for example, GORE-TEX, check-valves, duck-bill valves and the like.

It should be noted that the geometries of the refillable fluid container 400, manifold area 410, liquid fluid reservoir 420, a capillary fluid reservoir 430, barrier wall 440, orifice 450, filter means 460 and channel 480 are not particularly limited. Similarly, the location of the channel 480 within the refillable fluid container 400 is not particularly limited, other than specific limitations disclosed above.

The design of this invention has multiple advantages. In refillable systems, a system according to this invention may improve the volumetric efficiency of a printhead, which may have a larger sized reservoir and smaller manifold volume than conventional printhead systems. In the case of inkjet systems, the design of this invention increases the volume of ink that can be contained in the liquid fluid reservoir and capillary fluid reservoir of a printhead cartridge, reduced printhead, higher machine productivity and extended printhead life size.

While this invention has been described in conjunction with the exemplary embodiments outlined above, various alternatives, modifications, variations, improvements, and/or substantial equivalents, whether known or that are, or may be, presently unforeseen, may become apparent to those having at least ordinary skill in the art. Accordingly, the exemplary embodiments of the invention, as set forth above, are intended to be illustrative, not limiting. Various changes may be made without departing from the spirit and scope of the invention. Therefore, the systems, methods and devices according to this invention are intended to embrace all known or later-developed alternatives, modifications, variations, improvements, and/or substantial equivalents.

What is claimed is:

1. A fluid ejection container system for containing fluid, comprising:

a first chamber that contains the fluid and has associated therewith an air accumulation area;

a second chamber having at least one fluid ejection port;

a barrier separating the first chamber and the second chamber;

at least one channel bypassing the barrier to allow communication between the first chamber and the second chamber;

wherein the barrier is permeable to fluid but is not permeable to air when wetted with fluid.

2. A fluid ejection container system for containing fluid according to claim 1, further comprising:

a third chamber having a capillary medium that contains the fluid;

a passage between the first and third chambers communicating the fluid at a level wherein the passage is wetted with the fluid.

3. The fluid ejection container system according to claim 1, wherein the channel further comprises a flow limiting mechanism.

4. The fluid ejection container system according to claim 3, wherein the flow limiting mechanism allows communication from the third chamber into the first chamber.

5. The fluid ejection container system according to claim 3, wherein the flow limiting mechanism does not allow communication from the first chamber into the third chamber.

6. The fluid ejection container system according to claim 3, wherein the flow limiting mechanism allows one-way flow from the first chamber into the first chamber.

7. The fluid ejection container system according to claim 6, wherein the valve is a ball/spring valve.

8. The fluid ejection container system according to claim 3, wherein the flow limiting mechanism is a valve.

9. The fluid ejection container system according claim 8, wherein the valve is a check valve.

10. The fluid ejection container system according to claim 8, wherein the valve is a duck bill valve.

11. The fluid ejection container system according to claim 3, wherein the flow limiting mechanism is a filter material.

12. The fluid ejection container system according to claim 11, wherein the filter material is a membrane.

13. The fluid ejection container system according to claim 12, wherein the membrane is a fabric material.

14. The fluid ejection container system according to claim 3, wherein the flow-limiting mechanism is at least partially defined by a flow-limiting geometry.

15. The fluid ejection container system according to claim 1, wherein the air accumulation area includes an upper part of the first chamber.

16. The fluid ejection container system according to claim 1, wherein the air accumulation area is defined by an area of reduced cross-section provided above the first chamber.

17. The fluid ejection container system according to claim 16, further comprising a flow-limiting mechanism at least partially defined by a flow-limiting geometry of the reduced cross-section air accumulation area.

18. The fluid ejection container system according to claim 1, wherein the first chamber being evacuated to a negative gauge pressure when being filled with the fluid.

19. An ink jet printer comprising the fluid container system of claim 1, wherein the fluid is ink.

20. A fluid ejection cartridge comprising the fluid container system of claim 1 and a fluid ejection head.

21. An inkjet printer cartridge comprising the fluid container system of claim 1 and an inkjet printhead.

* * * * *